US010280586B2

(12) United States Patent
Lough et al.

(10) Patent No.: US 10,280,586 B2
(45) Date of Patent: May 7, 2019

(54) SECURITY APPARATUS

(71) Applicant: SmartWater Technology Limited, London (GB)

(72) Inventors: Julie Ann Lough, London (GB); Martin Foord, London (GB); Michael Cleary, London (GB)

(73) Assignee: SmartWater Limited (GB)

( * ) Notice: Subject to any disclaimer, the term of this patent is extended or adjusted under 35 U.S.C. 154(b) by 17 days.

(21) Appl. No.: 14/816,711

(22) Filed: Aug. 3, 2015

(65) Prior Publication Data

US 2016/0032553 A1 Feb. 4, 2016

(30) Foreign Application Priority Data

Aug. 4, 2014 (GB) ..... 1413788.9

(51) Int. Cl.
*E02D 29/14* (2006.01)

(52) U.S. Cl.
CPC ..... *E02D 29/1454* (2013.01)

(58) Field of Classification Search
CPC ..... E02D 29/1481
USPC ..... 52/2.11; 292/307 R
See application file for complete search history.

(56) References Cited

U.S. PATENT DOCUMENTS 3,991,594 A * 11/1976 Goenner ..... E05B 337/025 70/30
4,327,046 A * 4/1982 Davis ..... A47C 27/086 264/102
4,793,644 A * 12/1988 Swift ..... G09F 3/0358 292/320
5,052,851 A 10/1991 Frishauf
6,220,702 B1 * 4/2001 Nakamura ..... B41J 2/17503 206/524.8
7,153,057 B1 * 12/2006 Lucas ..... E02D 29/14 404/25
9,139,348 B2 * 9/2015 Voute ..... B65D 77/04
2004/0264813 A1 * 12/2004 Steffens ..... B65D 27/30 383/5
2005/0036716 A1 * 2/2005 Geyer ..... B65D 33/34 383/5
2008/0258476 A1 10/2008 Simpson
2011/0079533 A1 * 4/2011 Kasiwabara ..... B65D 81/051 206/522

(Continued)

FOREIGN PATENT DOCUMENTS

GB 2245583 A 6/1994
GB 2476099 A 6/2011
JP H11269900 A 10/1999

OTHER PUBLICATIONS

Search Report dated Oct. 6, 2015 in GB1413788.9—5 pages.

*Primary Examiner* — Paola Agudelo
(74) *Attorney, Agent, or Firm* — Forrest Firm, P.C.

(57) ABSTRACT

Disclosed herein is a security apparatus comprising a blocking device having a formable bag and a marker layer including a transferable marker composition that can be transferred onto any object penetrating the marker layer and any other object or person coming into contact with the marker composition in the event of an attempt to remove the blocking device by puncturing the bag. The blocking device may block an access point such as a manhole to block unauthorized access. The formable bag may be made to conform to the shape of an access passage by inflation or deflation using valve.

20 Claims, 4 Drawing Sheets

(56) References Cited

U.S. PATENT DOCUMENTS

| | | | | |
|---|---|---|---|---|
| 2011/0148647 | A1 | 6/2011 | Miller, II et al. | |
| 2011/0168764 | A1* | 7/2011 | Kasiwabara | B65D 81/03 229/87.02 |
| 2012/0009020 | A1* | 1/2012 | Kiest, Jr. | B29C 63/20 405/150.1 |
| 2012/0141210 | A1* | 6/2012 | Kiest, Jr. | E02D 29/128 405/150.2 |
| 2012/0187015 | A1* | 7/2012 | Kasiwabara | B65D 81/052 206/484.1 |
| 2014/0368343 | A1* | 12/2014 | Dobbins | E05G 1/005 340/541 |
| 2015/0040322 | A1* | 2/2015 | Cheng | A47G 9/1054 5/638 |
| 2015/0275153 | A1* | 10/2015 | Murphy | C11D 17/042 206/524.7 |

* cited by examiner

SECURITY APPARATUS

CROSS-REFERENCE TO RELATED APPLICATIONS

This application is claims priority to Great Britain Patent Application No. 1413788.9 filed Aug. 4, 2014, which is incorporated by reference herein in its entirety for all purposes.

BACKGROUND OF THE DISCLOSURE

Theft is an increasing problem; a recent study has suggested it accounts for almost half of all crimes committed in the UK. This includes unauthorised access to, and theft from, restricted areas. For example, figures released by the British Transport Police reports a 70% increase in metal theft related crime between 2009/10 and 2010/11 (Crime in England and Wales 2010/11 Windings from the British Crime Survey and police recorded crime (2nd Edition) Edited by: Rupert Chaplin, John Flatley and Kevin Smith, July 2011 HOSB). In 2011 the cost of metal theft to UK transport and utility companies was estimated at £800 million.

Use of markers to deter or detect theft is known. For example, WO 93/07233 discloses a spray containing a fluorescent material that is used to mark products susceptible to theft, or to spray a thief upon activation of a burglar alarm and WO 2012/175969 discloses application of a unique marker to an electrical cable during manufacture.

One situation in which unauthorised removal of property occurs is intrusion into restricted areas such as street utility boxes or manholes to allow access to underground cables. Under normal circumstances access to these areas are limited and protected by street furniture, manholes or other coverings; however coverings can be damaged accidentally by weather, traffic or wear and tear, or may be removed by authorised or unauthorised persons. Once the protective covering is damaged or removed these restricted areas are vulnerable to attack and unauthorised access, for example theft of cables. Furthermore, a removed manhole in a road or path may create a safety hazard.

US 2013/093884 discloses a device for detecting if a manhole has been moved from its expected position.

US 2013/212945 discloses a manhole cover tamper sensor.

It is an object of the disclosure to prevent or deter access to restricted areas, for example access passages such as manholes.

SUMMARY OF THE DISCLOSURE

A first aspect the disclosure provides security apparatus comprising a blocking device comprising a formable bag and a marker layer comprising a transferable marker composition.

A second aspect the disclosure provides a blocking device for blocking an access area defined by a perimeter, the device comprising a formable bag and a valve for inflation and deflation of the bag.

A third aspect, the disclosure provides a method of blocking an access area defined by a perimeter, the method comprising the steps of inserting a blocking device according to the second aspect into the access area and forming the bag to bring the hag into contact with the perimeter.

A fourth aspect the disclosure provides use of a blocking device according to the second aspect to block an access point.

A fifth aspect the disclosure provides a brace comprising a body and at least two legs extending from the body wherein the length of at least one leg is adjustable by a secure controller.

The blocking device of the second aspect may have any of the features of the blocking device as described with reference to the first aspect.

"Secure" as used herein with reference to the valve and with reference to the controller means operable with a key.

DESCRIPTION OF THE DRAWINGS

Exemplary embodiments will now be described in detail with reference to the drawings in which.

DETAILED DESCRIPTION

Figure 1:
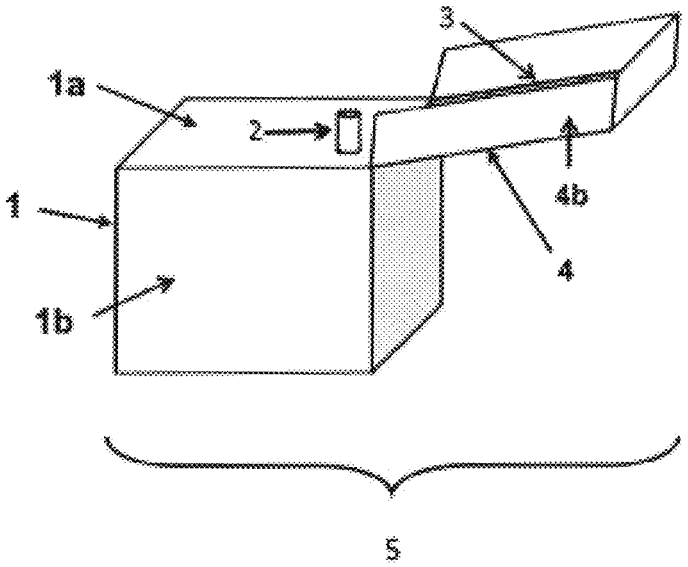
FIG. 1 illustrates security apparatus according to an embodiment of the disclosure comprising a formable bag, a cover and a layer of a marker composition.

With reference to FIG. 1, a blocking device 5 according to an embodiment of the invention comprises a formable bag 1. The bag is provided with a valve 2. A cover 4 is attached to the formable bag 1.

The bag has an upper surface 1*a* and side surfaces 1*b*. The cover 4 has a cover part 4*a* for covering the upper surface 1*a* and flaps 4*b* for covering at least part of side surfaces 1*b* of the bag when the cover 4 is in a closed position.

Figure 2A:
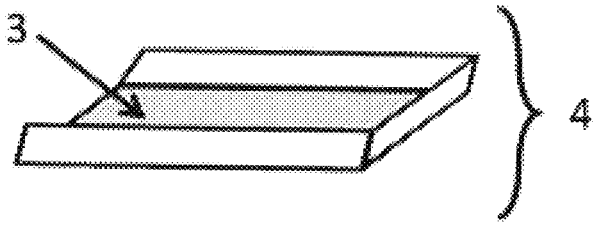
FIG. 2A illustrates the cover and the layer of marker composition of FIG. 1A

In use, the cover 4 of the bag covers upper surface 1*a* of bag 1. With reference to FIG. 2A, a surface of cover 4 carries a marker layer 3 of a marker composition. The marker composition may be provided in a pouch. The cover 4 may have a pocket 30 and in use the pouch containing the marker composition may be provided in the pocket.

The cover layer 4 of FIG. 1 is attached to the formable bag 1. In other embodiments, the cover layer 4 and the hag 1 may be separate. In other embodiments, two or more edges of the cover layer may be attached to the formable bag in which case one or more edges of the cover may not be attached to the formable bag to allow insertion of the pouch between the bag 1 and the cover layer 4.

Figure 2B:
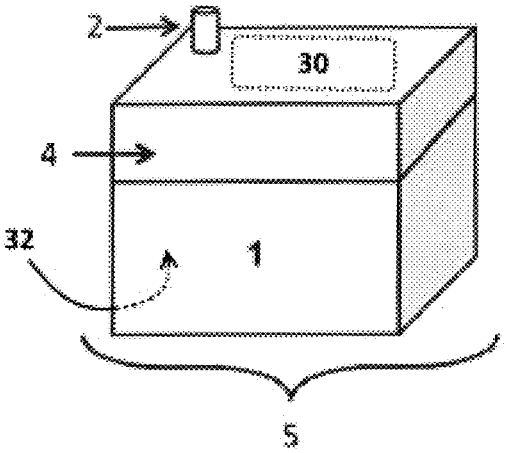
FIG. 2B illustrates the security apparatus of FIG. 1 following closure of the cover layer.

With reference to FIG. 2B, in use the marker composition is supported by upper surface 1*a* of the formable bag 1 and is provided between the cover 4 and the upper surface 1*a*.

Figure 3:
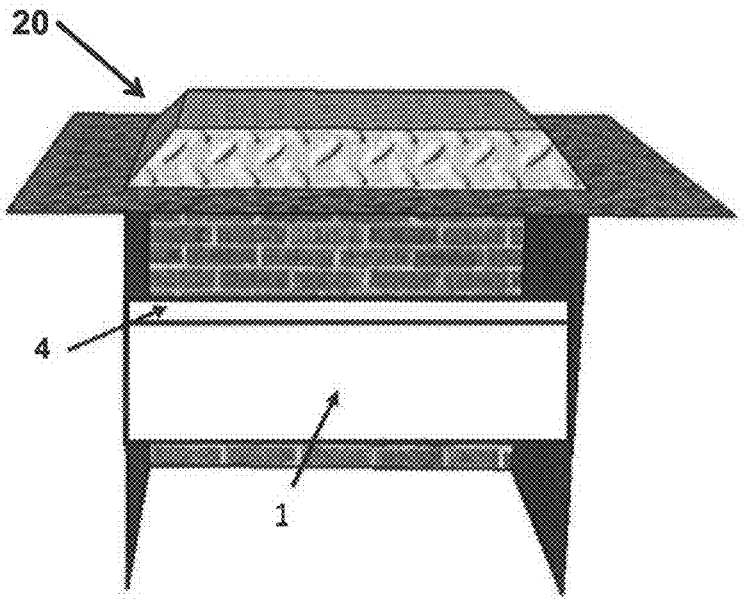
FIG. 3 illustrates a manhole blocked by security apparatus of FIG. 1.

With reference to FIG. 3, the formable bag 1 is then placed in an access passage, for example a manhole, and formed by evacuation or inflation using valve 2 so that the side surfaces 1*b* come into contact with the perimeter of the access passage and conform to the shape of the access passage. Cover 4 may contain a hole that valve 2 extends through when the cover 4 is in place, or valve 2 may be provided at a peripheral position on upper surface 1*a* that is not covered by the cover 4. Once the access passage has been blocked, any existing cover, such as manhole cover 20, may be replaced. It will be used that the blocking device may be used instead of or in combination with a separate cover.

The access passage may be a utility hole, a cable chamber, a maintenance hole, an inspection chamber, an access chamber or other confined space. Preferably, the access point is an access passage, optionally a manhole.

FIG. 3 illustrates blockage of an access passage. The blocking device 5 may be used to block other areas. For example, the blocking device 5 may be used to block access to the interior of a box, for example an on-street utility box containing wiring or utility controls, by inserting the blocking device 5 into the box and forming the formable bag 1 to conform to the perimeter of the box. The blocking device 5 may be used with or without a cover (e.g. door) for the box.

With reference to FIG. 1 the flaps 4*b* are held in place by the side surfaces 1*b* of the bag, and frictional engagement between the perimeter and the side surfaces 1*b* prevent unauthorised removal of the cover 4. In another embodiment, the flaps 4*b* are bound to side-surfaces 1*b*. The flaps may be bound by an adhesive or by use of cooperating binding means on the side surfaces 1*b* and the flaps 1*b* such as hook and loop (e.g. Velcro®) binders.

The bag 1 may contain beads 32, preferably polymer beads, more preferably polystyrene balls. Upon evacuation, the beads 32 press together and the formable bag 1 becomes rigid and conforms to the shape of the perimeter around the formable bag 1. According to this embodiment, the bag 1 is formable at atmospheric pressure but becomes rigid and conforms to the shape of the access passage upon evacuation.

In another embodiment the bag may conform to the shape defined by the perimeter of the access point upon inflation, in which case beads may or may not be present in the bag.

Once the bag has formed to the shape of the access point, the blocking device blocks the area defined by a cross-section of the perimeter. The marker layer 3 extends across at least part of the area defined by the perimeter. Preferably, the marker layer 3 extends across substantially all of the area defined by the perimeter.

Any attempt to remove the blocking device 5 by puncturing the bag 1 will result in penetration of the marker layer 3 and transfer of the marker composition onto the object penetrating the marker layer and any other object or person coming into contact with the marker composition.

The marker layer 3 illustrated in FIG. 3 is provided between a surface of a bag 1 and a cover layer 4, however it will be appreciated that the marker composition may be provided in any form such that the marker layer 3 extends across at least part of the area defined by the blocked perimeter when the blocking device is in use.

The marker layer 3 may be provided on any external or internal surface of the blocking device. The marker composition may directly contact a surface of the formable bag or may be separated therefrom by one or more layers. The marker composition may be applied directly to the cover layer 4 or to a layer of the formable bag 1. The marker composition may be provided in a pouch bound to or supported by an external or internal surface of the formable hag 1 or cover layer 4. It will be appreciated that the cover layer may or may not be present if marker layer 3 is concealed by a surface of the formable bag 1, for example if the marker layer 3 is provided on an internal surface of the formable bag 1.

The marker composition may be a liquid, solid or sol. The marker composition is preferably a viscous liquid or a gel and is preferably provided in a sealed pouch to prevent evaporation of a liquid of the composition, as described in more detail below, such that the marker composition transfers readily to any object coming into contact with the composition. Upon transfer, the liquid material of the composition may evaporate to form a film on the surface it has transferred onto.

The material of the formable bag may be any flexible material, and may be a single layer material or a composite, multilayered material. Preferably, material of the formable bag is inelastic. The material of the formable bag may be formed from or may comprise a layer of a thermoplastic material, for example thermoplastic polyurethane.

The valve 2 is preferably a secure valve. The valve 2 may contain a locking system in the form of a ball valve or may be a tamperproof valve. The valve 2 may be a two-part valve having a first part attached to the bag and a second removable part that may be retained for use by individuals with authority to remove the blocking device. The second part of the valve functions as a key to enable inflation or deflation of the bag 1.

Figure 4:
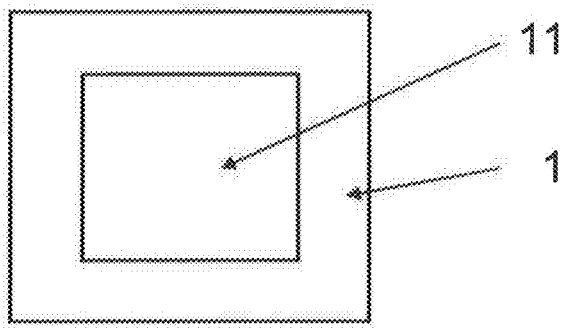
FIG. 4 illustrates a blocking device according to an embodiment of the disclosure.

The bag may extend across the whole of the area to be blocked, as illustrated in FIG. 1. FIG. 4 illustrates a plan view of an embodiment in which the blocking device comprises a rigid central part 11 and a bag 1 forming a perimeter of the rigid central part. In use, the surface of the central section and a surface of the bag illustrated in FIG. 4 may together block the area to be blocked. In use, the marker layer 4 may or may not extend across the part of the blocking surface defined by the rigid central part 11.

The blocking device illustrated in FIGS. 1 and 4 have a cuboid shape when formed to conform to the perimeter of an access point, but it will be appreciated that the blocking device may have any shape, and the device shape may be selected according to the shape of the access passage that it is to block. For example, the bag may be cylindrical. The bag may be manufactured so that it takes the shape of the access passage that it is to be inserted into upon expansion.

The blocking device 5, when formed, may have a blocking surface with a radius (in the case of a substantially cylindrical device) or a diagonal (in the case of a cuboid device) in the range of about 20 cm-200 cm, optionally about 50 cm-150 cm. The device may have a thickness, when formed, in the range of about 10-100 cm optionally about 10-50 cm.

Formable bags as described herein may be formed by evacuation or inflation from a single valve, for example as illustrated in FIG. 1, or may comprise a plurality of separately formable regions each with its own valve.

In exemplary embodiments a bag forming a blocking device may include a plurality of distinct air chambers. In some embodiments, the chambers may provide for structural redundancy. Thus, in some embodiments a first chamber may be punctured without the bag loosing structural integrity. The puncture of the first chamber may provide marking. In some embodiments, a shape and/or size of the bag may be selected based on a particular inflation configuration of the hag. Thus, a first bag may be adapted to fit different sized/shaped access points depending on an inflation configuration.

The marker composition comprises at least one marker material dissolved or dispersed, preferably dissolved, in a liquid. Each marker material can be identified using known analytical techniques including, without limitation, spectroscopic and chromatographic techniques, for example mass spectrometry, atomic emission spectroscopy, atomic absorption spectroscopy, LA-ICP-MS; x-ray fluorescence spectroscopy; laser induced breakdown spectroscopy, gas chromatography; PCR; and gel electrophoresis.

A unique marker composition may be formed by varying parameters including, without limitation, identity of a marker; combination of different marker materials; concentration of an individual marker within the composition; and relative concentrations of two marker materials.

The composition may contain a single marker material, but preferably contains a plurality of different marker materials and may contain at least two, at least three, at least four, at least five or at least ten, at least twenty different marker materials. Optionally, the composition comprises up to forty or up to thirty different marker materials.

The greater the number of marker materials used, the greater the number of unique combinations available for use. Furthermore, a greater number of marker materials in a composition may provide a greater degree of certainty in identification of the source of the composition.

The concentration of marker materials may be between 0.0000001%-15% (1 ppb-150,000 ppm) for each component, optionally 5-100,000 ppm, optionally 100-10,000 ppm. Optionally each marker material is provided in an amount of at least 25 ppm, optionally at least 50 ppm. Concentration of marker materials may be measured by ICP-mass spectrometry or ICP atomic emission spectroscopy as a weight per volume of the marker material.

A marker composition may be formed as described in UK Patent GB 2413674, the contents of which are incorporated herein by reference. The formulation of unique combinations of marker materials can be prepared using a binary method; however other methods comprising octal and hexadecimal strings can also be used. Each marker composition is held on a database of forensic codes and assigned to a specific owner and/or location. With this database, forensic analysis of a marker composition on an object or on a suspected offender can be used to identify the owner of a marked object or the location at which an offence occurred.

Preferably, the or each marker is an uncommon material provided at a concentration that would not normally be present in the field of use. Exemplary marker materials are metal compounds and organic compounds.

Exemplary metals of metal compound markers include alkali earth metals, d-block metals, lanthanides, for example Lanthanum, Europium and Holmium; and p-block metals, for example Tellurium and Gallium.

Exemplary organic marker compounds include, tetrahydrocarbazole derivatives and methoxybenzonitrile derivatives.

The or each marker material may be dissolved or dispersed in the composition. Preferably, the or each marker material is dissolved and the metal salt may be selected accordingly.

Exemplary metal compound markers include metal oxides, metal triflates, metal halides, metal nitrates, metal sulfates, and metal sulfides.

The composition preferably contains at least one light-emitting material, preferably a photoluminescent light-emitting material dissolved or dispersed, preferably dissolved, in the liquid. The or each light-emitting material may independently be fluorescent or phosphorescent. This material can act as a preliminary indicator to indicate the presence of the composition on persons, goods, premises or other property. Upon preliminary identification, the composition may be analysed in detail to identify the markers in the composition.

This indicator can be either overt and/or covert.

Overt indicators emit light in the visible wavelength that can be seen without any apparatus and may be selected from, for example, microdots, pigments and dyes.

Covert indicators can be viewed only with the use of a suitable stimulus, for example photoluminescent materials that only emit visible radiation when excited by radiation other than visible light, for example upon excitation with a UV lamp. Exemplary covert indicators are coumarins, oxazinones, stilbenes, fluoresceins and derivatives thereof. Coumarins, oxazinones, stilbenes and derivatives thereof are preferred.

Preferably, the light-emitting material is soluble in the liquid of the composition.

More than one light-emitting material may be present in the composition, for example materials that emit radiation of different wavelengths, for initial identification of the composition.

The or each light-emitting material may be used in a concentration of between 0.05 to 40% by weight of the composition.

The composition preferably comprises at least one polymer. A polymer may be provided to increase viscosity of the composition or to form a gel composition.

A liquid composition may have any viscosity, and preferably a viscosity of at least about 2,000 Pa·s., optionally about 2,000-100,000 Pa·s, or it may be non-Newtonian, and the quantity of polymer in the composition may be selected accordingly. The liquid and the at least one polymer of the composition may form a gel.

Exemplary polymers for altering the rheology of the composition include cellulose derivatives, acrylic co-polymer derivatives or alkali acrylic emulsions that swell when in contact with water. A preferred class of polymers are anionic acrylates.

The composition may comprise a polymer for improving adhesion of the composition. Exemplary polymers with good adhesive properties are polyacrylates and polyacetates and polystyrenes, for example polymethyl methacrylate and polystyrenebutadiene.

The liquid of the composition may be a single liquid material or a mixture of liquid materials. The one or more polymers, the one or more light-emitting materials and the one or more markers may be dissolved or dispersed in the liquid.

It will be understood that "liquid material" as used herein is a material that is liquid 20° C., and that the liquid when mixed with other components of the composition may form part of a gel. Suitably, the liquid consists of or comprises water. Exemplary further liquid materials include alcohols, preferably alcohols having a boiling point of less than 100° C., for example propanol and esters, for example glycerol trioleate or isopropyl myristate.

The blocking device 5 provides a physical barrier against access to a restricted area. Use of the marker composition, and the use of suitable signage on or near the blocking device warning of the presence of the marker composition, may deter illegitimate attempts to access an area blocked by the blocking device for example as described in US 2013/095230, the contents of which are incorporated herein by reference. In the case of manholes, the blocking device may prevent or reduce the severity of injuries arising from trips or falls where a manhole cover has been removed.

In use, the blocking device may be used alone to block an area defined by a perimeter or may be used in combination with a further device.

Figure 5:
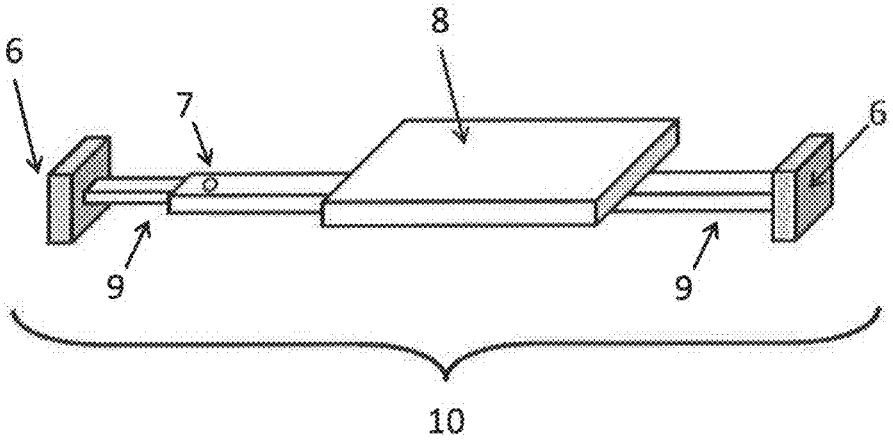
FIG. 5 illustrates a support brace according to an embodiment of the disclosure.

In one embodiment the blocking device 5 may be used with a brace. An exemplary brace is illustrated in FIG. 5.

The brace 10 comprises a body having at least two legs 9 extending therefrom, of which at least one leg has an adjustable length. Preferably, the or each adjustable leg is disposed within a shaft of the body, and is moveable relative to the shaft. The legs may have feet 6. The or each adjustable leg 9 may be extended or retracted by a controller 7 connected to a mechanism for extending and retracting adjustable leg 9, for example a winding mechanism controlled by rotation of controller 7.

If the brace comprises more than one adjustable leg then each adjustable leg may have an associated controller 7 or two or more adjustable legs may be controlled by a single controller 7.

Controller 7 may comprise a knob that may be grasped manually or by a tool for rotation of the knob 7, in another embodiment, controller 7 may be a secure controller. Controller may comprise a lock that engages with a key to allow adjustment of the legs, for example by rotation of the controller to effect winding or unwinding of the mechanism and extension of the legs. The key that engages with the lock may be part of a tool for manual or automated rotation of controller 7.

The legs of the brace are arranged to engage with a perimeter. Two of the legs may extend in substantially opposite directions to engage with opposing perimeter walls.

The brace may comprise three or more legs of which one or more may be adjustable. The three or more legs may extend in one of two substantially opposite directions or may extend in three or more directions.

The brace may comprise a platform 8.

Figure 6A:
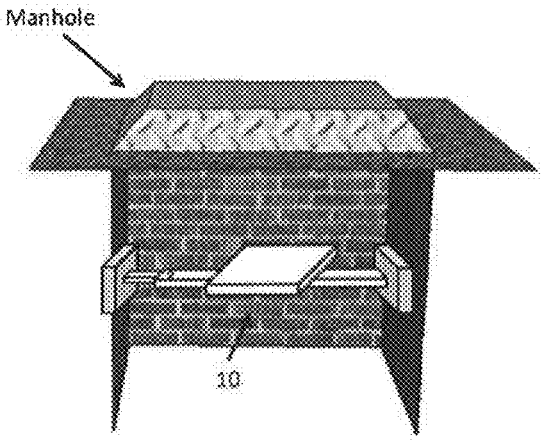
FIG. 6A illustrates a step of a method of blocking a manhole according to an embodiment of the disclosure by engaging a support brace against walls of the manhole.
Figure 6B:
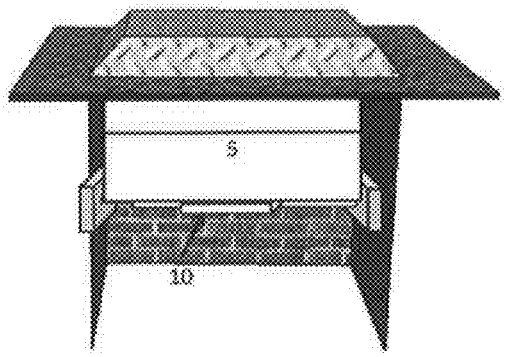
FIG. 6B illustrates a blocked manhole wherein a blocking device formed to contact the perimeter of the manhole is supported on the support brace of FIG. 5A.
Figure 7:
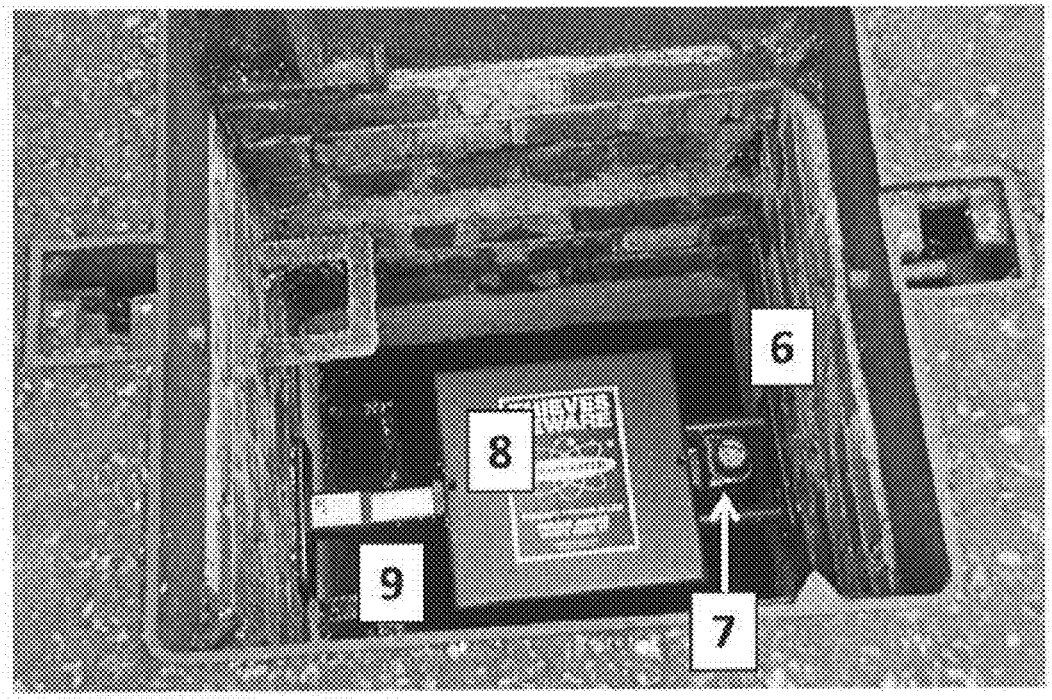
FIG. 7 illustrates a brace according to an embodiment of the disclosure in a manhole.
Figure 8:
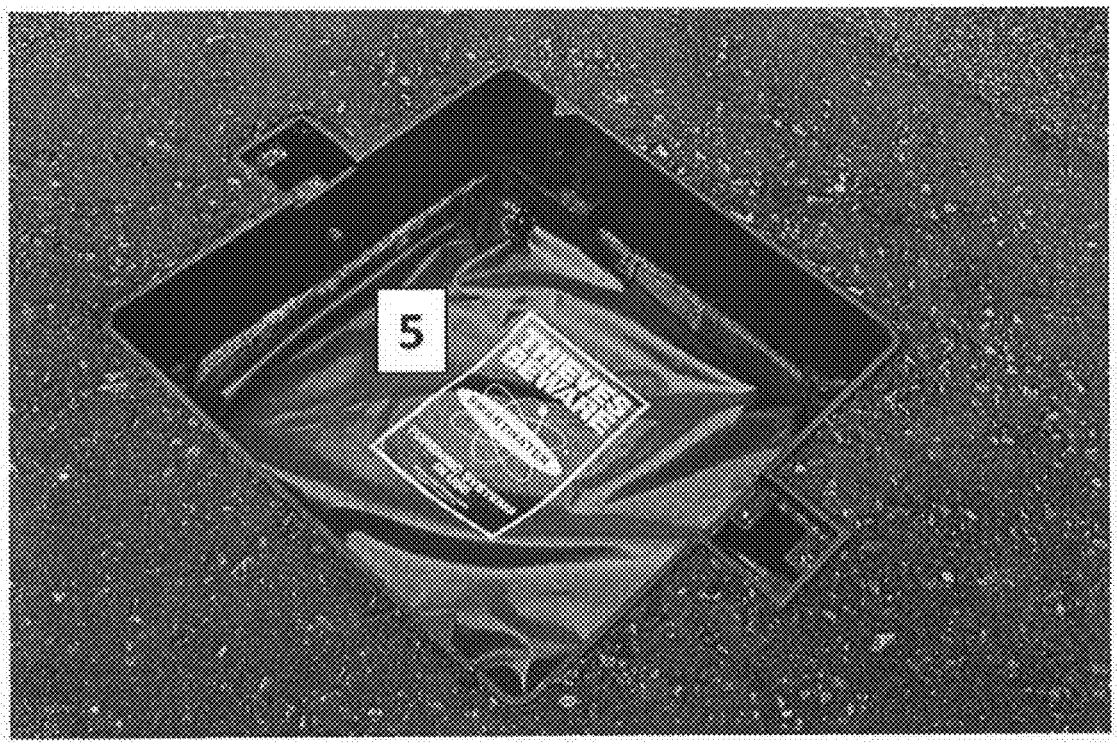
FIG. 8 illustrates a manhole blocked by a blocking device according to an embodiment of the disclosure.

With reference to FIGS. 6A and 6B, a brace 10 may be placed in an access passage first and the blocking device 5 may then be placed on the brace. The brace 10 may be used to support the blocking device 5 in its formable state, either before it is formed to conform to the perimeter of the access point or after being returned to its formable state to allow access.

In the event that the blocking device 5 is removed illegitimately then the brace 10 may provide a further block against unauthorised access to the access passage, particularly if the brace 10 comprises a secure controller 7.

In other embodiments, the brace may be held in place by other means, for example by hooks.

In other embodiments the brace may be used without the blocking device, either to provide a block against unauthorised entry or for other purposes. If used without a blocking device, platform 8 may be used to hold tools while work is carried out in an access passage containing the brace 10.

Although the present disclosure has been described in terms of specific exemplary embodiments, it will be appreciated that various modifications, alterations and/or combinations of features disclosed herein will be apparent to those skilled in the art without departing from the scope of the invention as set forth in the following claims.

What is claimed is:

1. Security apparatus comprising a blocking device comprising:

a formable bag; and a marker layer including marker compositions readily transferable from the marker layer to an object upon contact of the object with the marker layer, wherein the formable bag contains beads, and wherein the marker layer is provided on an internal surface of the blocking device.

2. Security apparatus according to claim 1 wherein a surface of the blocking device defines a blocking area and wherein the marker layer extends across at least a part of the blocking area.

3. Security apparatus according to claim 1 wherein the blocking device comprises a rigid central part; the formable bag forms a perimeter of the rigid central part; and a blocking area extends across a surface of the rigid central part and a surface of the formable bag.

4. Security apparatus according to claim 1 wherein a blocking area extends across a surface of the bag only.

5. Security apparatus according to claim 1 wherein the marker layer is provided in a pouch.

6. Security apparatus according to claim 5 wherein the marker layer is a liquid or a gel.

7. Security apparatus according to claim 1 wherein the apparatus further comprises a cover layer for covering a surface of the formable bag.

8. Security apparatus according to claim 7 wherein the cover layer is bound to the formable bag.

9. Security apparatus according to claim 7 wherein the cover layer comprises a pocket containing a pouch comprising the marker layer.

10. Security apparatus according to claim 7 wherein the cover layer comprises binding means for binding the cover to the formable bag.

11. Security apparatus according to claim 1 wherein the blocking device comprises a valve for inflation or evacuation of the bag.

12. Security apparatus according to claim 11 wherein the valve is a secure valve.

13. Security apparatus according to claim 1 wherein the marker layer comprises a uniquely identifiable composition of materials.

14. A blocking device for blocking an access area defined by a perimeter, the device comprising:

a formable bag and a valve for inflation and deflation of the bag, wherein the valve is a secure valve operable to be locked in a closed position with a key; and a marker layer including marker compositions readily transferable from the marker layer to an object upon contact of the object with the marker layer.

15. A blocking device according to claim 14 wherein the formable bag contains beads.

16. A blocking device according to any of claim 14 wherein a cover layer for covering a surface of the formable bag is bound to the bag.

17. A blocking device according to according to claim 16 wherein the cover layer comprises binding means for binding the cover layer to the formable bag.

18. A blocking device according to claim 14 wherein the valve is a two-part valve having a first part attached to the bag and a second removable part being the key.

19. A blocking device according to claim 18 wherein the second part of the valve functions as the key to enable inflation or deflation of the bag.

20. A blocking device according to claim 14 having a thickness, when formed, in the range of 10-100 cm.

* * * * *